US009302406B2

(12) United States Patent
Kato et al.

(10) Patent No.: US 9,302,406 B2
(45) Date of Patent: Apr. 5, 2016

(54) POWER TOOLS

(75) Inventors: Kazuya Kato, Anjo (JP); Takuji Kimura, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 1053 days.

(21) Appl. No.: 13/423,676

(22) Filed: Mar. 19, 2012

(65) Prior Publication Data

US 2012/0241048 A1 Sep. 27, 2012

(30) Foreign Application Priority Data

Mar. 22, 2011 (JP) ..... 2011-062261

(51) Int. Cl.
*B27C 5/10* (2006.01)
*B27C 1/14* (2006.01)
*B25F 5/02* (2006.01)

(52) U.S. Cl.
CPC ... *B27C 5/10* (2013.01); *B25F 5/02* (2013.01); *B25F 5/021* (2013.01); *B27C 1/14* (2013.01)

(58) Field of Classification Search
CPC ..... B27C 1/005; B27C 1/02; B27C 1/14; B27C 5/10; B27C 7/00; B27C 7/04; B27C 7/06; B25F 5/02
USPC ..... 144/136.95, 136.1, 154.5; 173/2, 47, 173/217, 171
See application file for complete search history.

(56) References Cited

U.S. PATENT DOCUMENTS

| | | | | |
|---|---|---|---|---|
| 3,466,973 | A | 9/1969 | Rees | |
| 3,767,948 | A | 10/1973 | Batson | |
| 6,729,414 | B2 * | 5/2004 | Cooper | B25F 5/02 173/216 |
| 6,886,961 | B2 * | 5/2005 | Hara | B25F 5/021 362/109 |
| 7,073,993 | B2 * | 7/2006 | Cooper | B25F 5/00 144/136.95 |
| 2006/0147286 | A1 | 7/2006 | Cooper et al. | |
| 2011/0229283 | A1 | 9/2011 | Kato et al. | |
| 2012/0045290 | A1 | 2/2012 | Shibata et al. | |

FOREIGN PATENT DOCUMENTS

| | | |
|---|---|---|
| JP | A-2002-234001 | 8/2002 |
| JP | A-2002-337073 | 11/2002 |

OTHER PUBLICATIONS

Extended European Search Report issued in European Patent Application No. 12 16 0361.7 dated Jun. 25, 2012.

* cited by examiner

*Primary Examiner* — Matthew G Katcoff
(74) *Attorney, Agent, or Firm* — Oliff PLC

(57) ABSTRACT

A power tool has a tool unit and a base device. The tool unit has a housing having a drive device disposed therein. The base device has a clamp surface that can clamp a contact surface of the housing for supporting the tool unit. The housing may include an internal housing portion and an external housing portion positioned on an outer side of the internal housing portion. The external housing portion may define the contact surface of the housing. The internal housing portion may be made of a first material. The external housing portion may be made of a second material that is different from the first material.

21 Claims, 5 Drawing Sheets

POWER TOOLS

This application claims priority to Japanese patent application serial number 2011-062261, the contents of which are incorporated herein by reference.

BACKGROUND OF THE INVENTION

1. Field of the Invention

The present invention relates to power tools, such as those used for trimming and grooving wooden workpieces.

2. Description of the Related Art

Power tools known as trimmers and routers have been used for trimming or grooving wooden workpieces. In general, this kind of power tools includes a base device and a tool unit that is also called a motor unit. The base device is adapted to contact with a workpiece, and may be placed on a workpiece. The tool unit is supported by the base device with the tool unit being positioned relative to the base device. Due to positioning of the tool unit relative to the base, the tool unit can be also positioned relative to the workpiece with which the base device contacts. The tool unit has a drive motor disposed therein for rotatably driving a spindle. A tool bit may be mounted to the spindle for machining a workpiece. A plurality of tool bits may be prepared for selectively mounted to the spindle depending a machining work to be performed.

The drive motor is disposed within a housing of the tool unit. The housing serves as an enclosure. Therefore, the housing is positioned relative to the workpiece while it serves as an enclosure for the drive motor. Various techniques relating to these functions are disclosed, for example, in Japanese Laid-Open Patent Publications Nos. 2002-234001 and 2002-337073.

The housing of the tool unit may be formed of synthetic resin for ensuring insulation of the drive motor and the other electric components disposed within the housing. However, there is a possibility that the resin molded housing is deformed due to absorption of moisture or is flexed due to change of temperature. When this occurs, the configuration of the outer circumferential surface of the housing may be changed to cause such an event that the base device is caught by the outer circumferential surface of the tool unit when the tool unit is moved to slide relative to the base device. In such a case, the tool unit may not be smoothly slid.

On the other hand, the housing may be formed of metal in order to enable the base device to clamp uniformly around the outer circumferential surface of the housing. The metal housing may not be easily deformed as in the case of the resin housing when the base device clamps the housing. Therefore, the outer circumferential surface of the housing can be uniformly clamped. However, in the case of the metal housing, it is difficult to ensure insulation of the drive motor and the other electric components disposed within the housing.

Therefore, there has been a need in the art for a power tool that can ensure insulation of electric components disposed within a housing and can keep accuracy in size or configuration of an outer circumferential surface of the housing.

SUMMARY OF THE INVENTION

In one aspect according to the present teachings, a power tool has a tool unit and a base device. The tool unit has a housing having a drive device disposed therein. The base device has a clamp surface that can clamp a contact surface of the housing for supporting the tool unit. The housing may include an internal housing portion and an external housing portion positioned on an outer side of the internal housing portion. The external housing portion may define the contact surface of the housing. The internal housing portion may be made of a first material. The external housing portion may be made of a second material that is different from the material of the first.

DETAILED DESCRIPTION OF THE INVENTION

Figure 1:
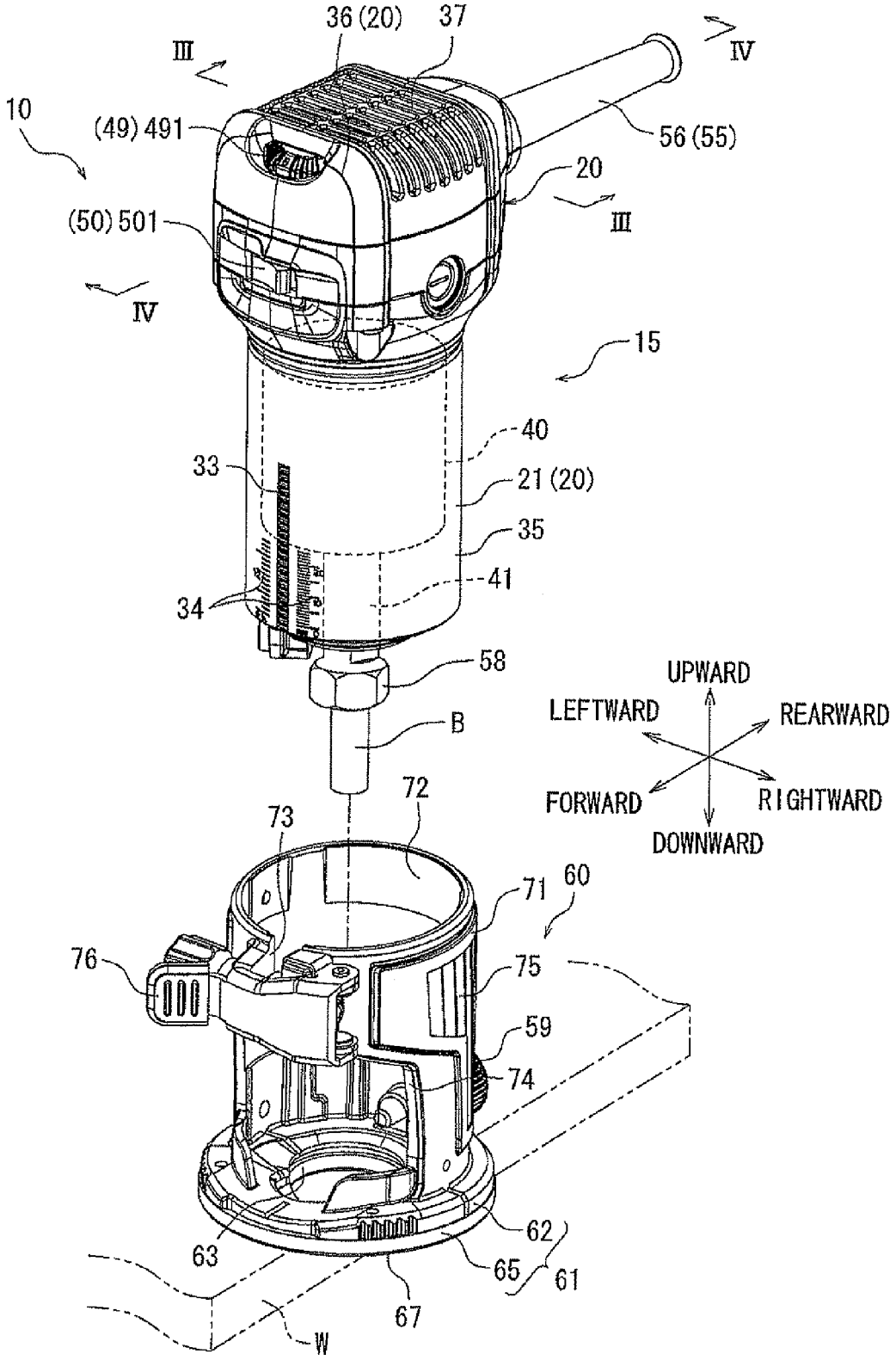
FIG. 1 is an exploded perspective view of power tool having a tool unit and a base device.

Each of the additional features and teachings disclosed above and below may be utilized separately or in conjunction with other features and teachings to provide improved power tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings. Various examples will now be described with reference to the drawings.

In one example, a power tool includes a tool unit and a base device. The tool unit can perform a machining operation of a workpiece. The base device defines a base surface for contacting with the workpiece and is configured to support the tool unit with the tool unit positioned relative to the workpiece. The tool unit includes a housing and a rotary drive device disposed within the housing. The housing has an outer circumferential surface that includes a contact surface to be clamped by the base device. The housing includes an internal housing portion and an external housing portion that are integrated with each other to form a double housing structure. The internal housing portion is made of resin and is opposed to the rotary drive device. The external housing portion is made of metal and defines the contact surface of the housing. For example, the power tool may be used for a trimming operation or a grooving operation of a wooden workpiece.

Because the internal housing portion opposed to the rotary drive device is made of resin, it may be possible to provide an electrical and thermal insulation for the rotary drive device that may be an electric motor or an internal combustion engine. In addition, because the external housing portion that may be held by the base device is made of metal, it is possible to prevent or minimize potential deformation of the external housing portion, which may be caused due to absorption of moisture or due to change in temperature.

Therefore, it is possible to provide a reliable electrical and thermal insulation and to ensure accuracy in size and configuration of the contact surface of the housing. Hence, the tool unit can be smoothly moved relative to the base device during positioning of the tool unit.

The rotary drive device may be assembled into the internal housing portion in a first direction. The internal housing portion having the rotary drive device assembled therein may be assembled into the external housing portion in a second direction that is opposite to the first direction.

Therefore, the load applied to the internal housing portion during assembling of the rotary drive device into the internal housing portion may be opposite to the direction of application of the load to the external housing portion during the assembling operation of the internal housing portion into the external housing portion. Thus, the load may be dispersedly applied to the housing during the assembling operation, so that the strength of the housing can be ensured. As a result, it is possible to ensure accuracy in size and configuration of the contact surface of the housing also in this respect.

The rotary drive device may include a drive motor having a stator and a rotor. The stator may have a first end and a second end. The first end is positioned on the side of the base surface of the base device and the second end is positioned on the side opposite to the first end. The contact surface of the housing has a length, so that the stator is positioned substantially within the length of the contact surface.

With this arrangement, the stator may support the housing against a potential force applied by the base device when the base device clamps the housing at the contact surface. This may serve to accurately maintain the size and the configuration of the contact surface.

In this connection, the contact surface of the housing may have a first surface end and a second surface end along the length. The first surface end may be positioned on the side of the base surface of the base device and the second surface end may be positioned on the side opposite to the first surface end. The second surface end may be positioned proximal to the second end of the stator with respect to a direction along the length of the contact surface.

The contact surface of the housing may be finished by a machining operation. In particular, in the case that the external housing portion is a die-cast product, the contact surface may be machined to have a desired size and shape.

Figure 2:
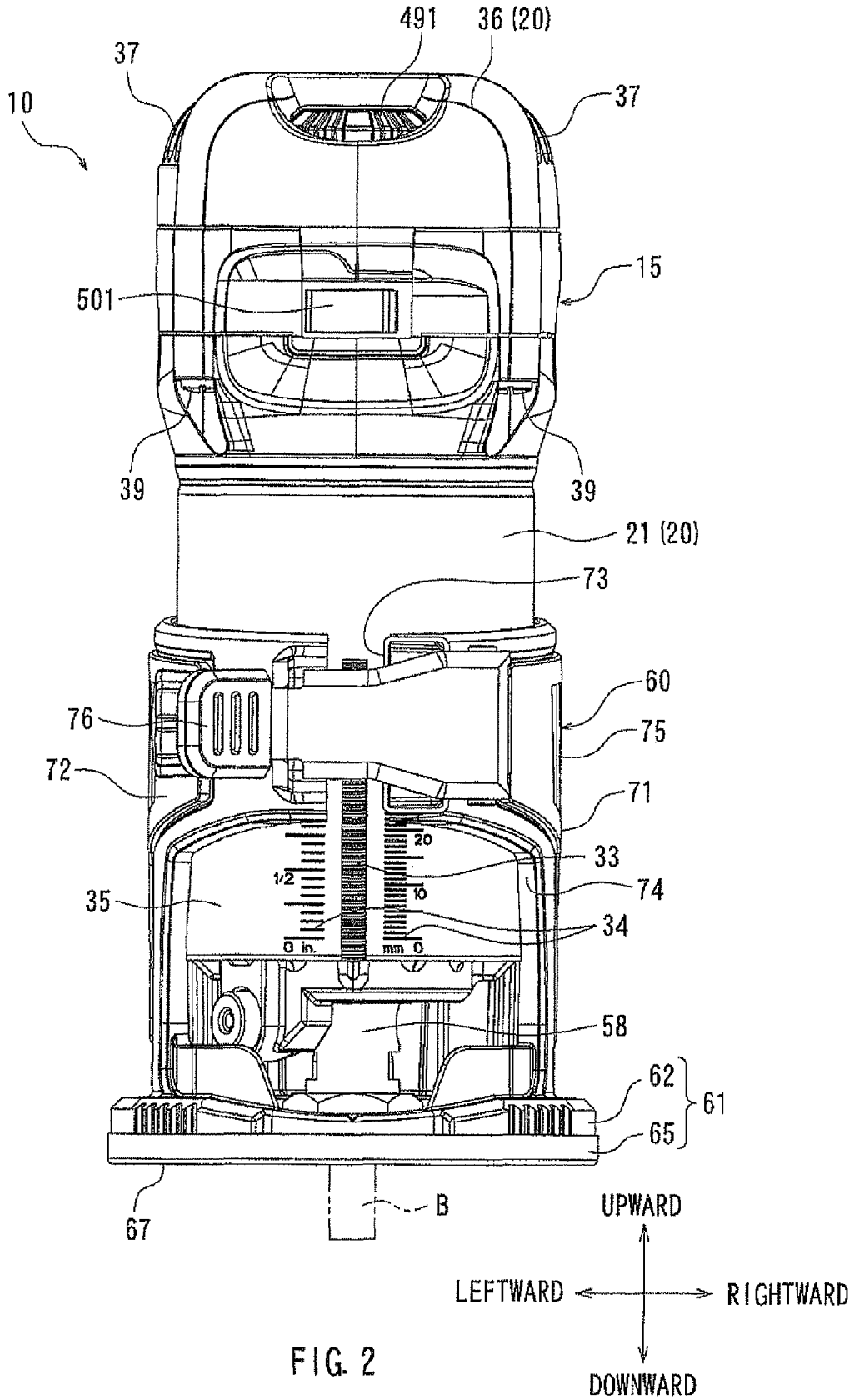
FIG. 2 is a front view of the power tool in the state where the tool unit and the base device have been assembled with each other.

A representative example will now be described with reference to the drawings. Referring to FIG. 1, a power tool 10 generally includes a tool unit 15 and a base device 60 that are shown in a state of being separated from each other in FIG. 1. FIG. 2 shows a front view of the power tool 10 in a state where the tool unit 15 and the base device 60 are assembled with each other.

In this example, the power tool 10 is configured as trimmer that may be used for an edge cutting operation (trimming operation) and a grooving operation of a wooden workpiece W. The tool unit 15 is configured to be able to machine the workpiece W. The base device 60 is configured to support the tool unit 15. The tool unit 15 includes a drive motor 40 that serves to produce a rotational driving force for rotatably driving a spindle 41. A chuck device 58 can mount a tool bit B to an end portion of the spindle 41. The tool bit B may serves as a working tool for machining the workpiece W. The chuck device 58 may be a device known as a collet cone and may releasably clamp the tool bit B. Therefore, the tool unit 15 can perform a machining operation by the tool bit B that is rotatably driven together with the spindle 41.

The base device 60 will now be described. The base device 60 has a base surface 67 for contacting with the workpiece W. The base device 60 can support the tool unit 15 with the tool unit 15 positioned relative to the base device 60. The base device 60 generally includes a base section 61 for contacting with the workpiece W and a clamp structure section 71 that is integrated with the base section 61. The base section 61 is designed to allow the tool bit B of the tool unit 15 to protrude downward beyond the base surface 67 that defines a lower surface of the base section 61. The basesection 61 includes a flange 62 and a base 65. The flange 62 includes a central through-hole 63 extending therethrough in the vertical direction. The flange 62 is positioned within a horizontal plane. The base 65 is detachably attached to the flange 62 by means of screws or any other suitable fastening device (not shown) and may have a configuration similar to the flange 62 in plan view. The lower surface of the base 65 serves as the base surface 67. Therefore, the tool bit B mounted to the tool unit 15 can extend downwardly from the base surface 67 through the though-hole 63 of the flange 62 and through a corresponding though-hole formed in the base 65. The clamp structure section 71 has a substantially tubular configuration and extends upward from the flange 62. A parallel ruler (not shown) can be mounted to the clamp structure section 71 by means of a fastening device 59.

The clamp structure section 71 includes a C-shaped tubular member 72 integrated with the flange 62, and a clamp device 76 disposed at a front portion of the tubular member 72. A slit 73 is formed in the front portion of the tubular member 72. The clamp device 76 is operable to increase or decrease the width of the slit 73, so that the diameter of the tubular member 72 can be increased and decreased due to resilient deformation. As the diameter of the tubular member 72 decreases, the tubular member 72 clamps a contact surface 35 that is a part of the outer circumferential surface of the tool unit 15. The inner circumferential surface of the tubular member 72 serves as a clamp surface that clamps the contact surface 35 for supporting the tool unit 15 as will be explained later. As the diameter of the tubular member 72 increases, the tubular member 72 unclamps the contact surface 35 of the tool unit 15, so that the tool unit 15 can slidably move relative to the tubular member 72.

A window 74 is formed in the tubular member 72 at a position on the lower side of the slit 73 and in continuity with the slit 73. The window 74 is positioned to allow the operator to view the through-hole 63 through which the tool bit 13 protrudes downward. An elastomeric layer 75 is formed on the outer circumferential surface of the tubular member 72 and serves as a slip-preventing portion for preventing slippage of a hand(s) of the operator. The outer surface of the elastomeric layer 75 is convexed and concaved at suitable intervals. Due to the concave and convex configurations and the elasticity of the elastomeric layer 75, the operator can firmly grasp the elastomeric layer 75.

The clamp device 76 is disposed over the slit 73 of the front portion of the tubular member 72. The clamp device 76 generally includes a lever mechanism operable to increase and decrease the width of the slit 73, and a dial mechanism operable to move the tool unit 15 upward and downward relative to the base device 60. The clamp device 76 has an operation rod that is a part of the lever mechanism and also serves as a part of the lever mechanism. Therefore, after adjustment of the vertical position of the tool unit 15 relative to the workpiece W by the operation of the dial mechanism, the tubular member 72 can clamp the contact surface 35 of the tool unit 15 to fix the tool unit 15 in position.

The internal structure of the tool unit 15 will now be described with reference to FIGS. 3 and 4. The tool unit 15 includes a housing 20 serving as an outer casing. A drive motor 40 is disposed within the housing 20, so that the housing 20 also serves as an enclosure for the drive motor 40. More specifically, the hosing 20 includes a motor housing 21 positioned on the lower side that is the side of the workpiece W, and a head housing 36 positioned on the upper side of the motor housing 20 and integrated with the motor housing 21. The motor housing 21 and the head housing 36 may be joined to each other by means of screws (not shown).

Figure 3:
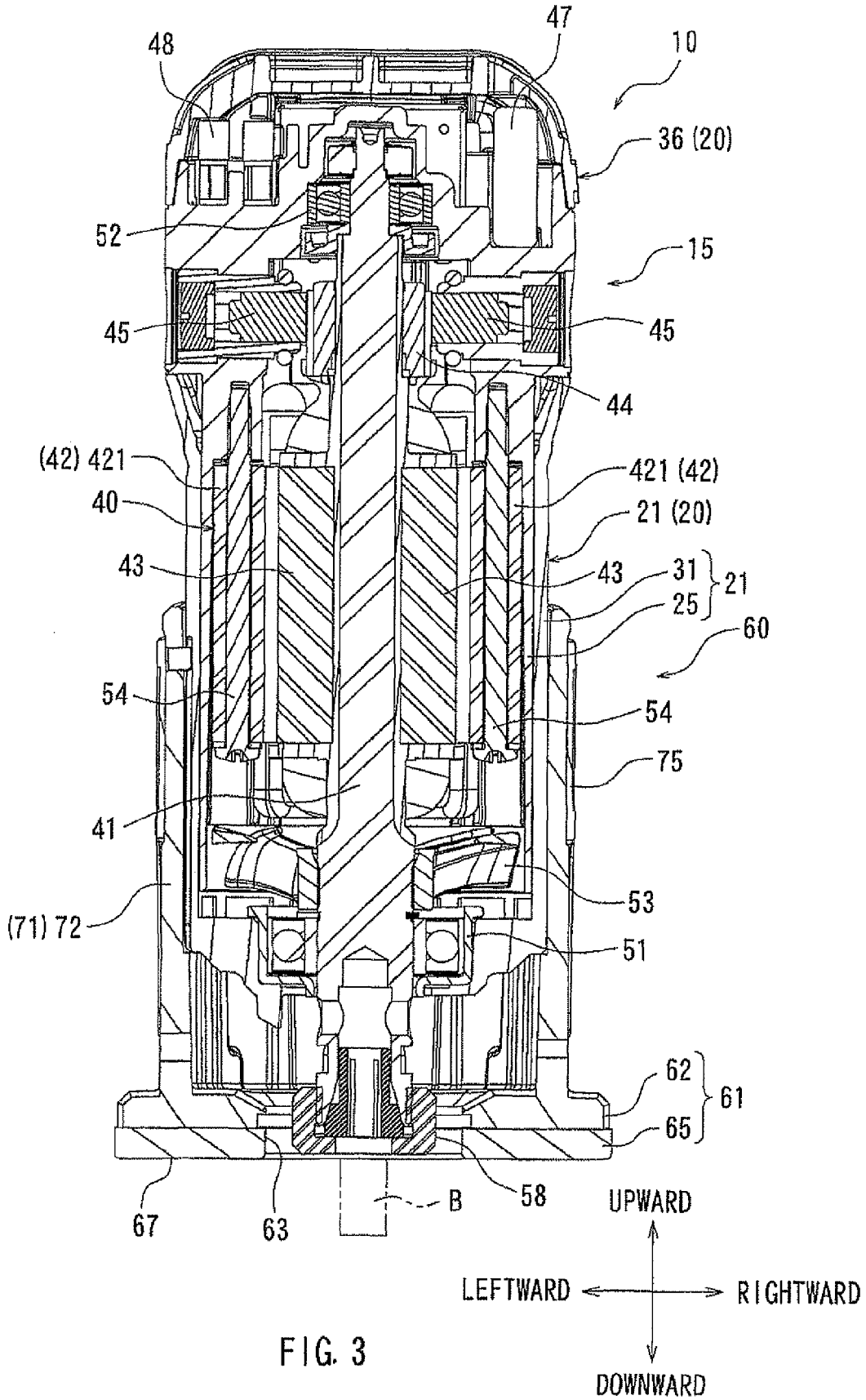
FIG. 3 is a vertical sectional view of the power tool taken along line III-III in FIG. 1.
Figure 4:
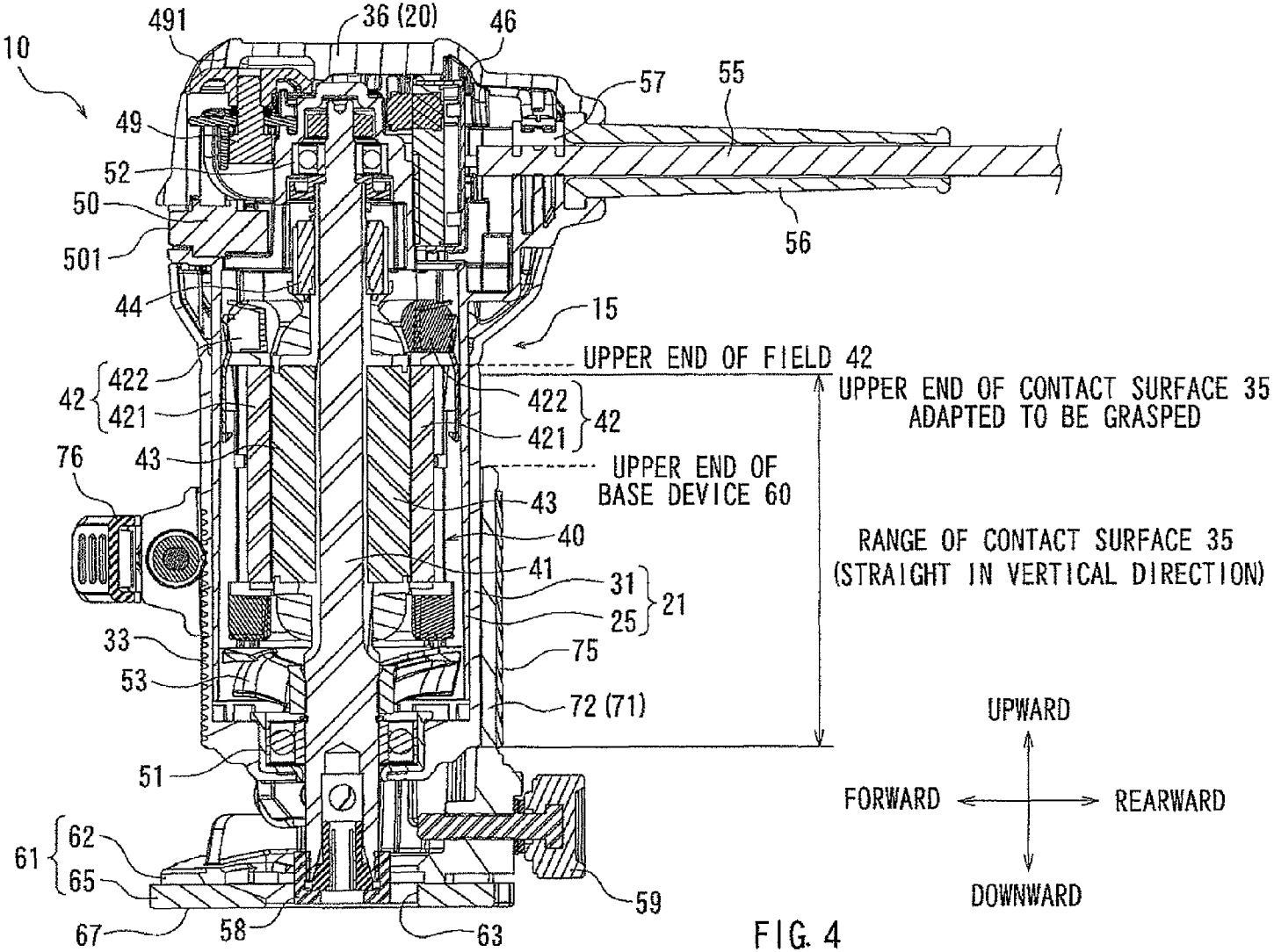
FIG. 4 is a vertical sectional view of the power tool taken along line IV-IV in FIG. 1.

As shown in FIGS. 3 and 4, the drive motor 40 is disposed within the tool body 15 at an intermediate position of the tool body 15 with respect to the vertical direction. The spindle 31 extends vertically though the drive motor 40. The drive motor 40 serves as a rotary drive mechanism and is configured as a brushed motor. The drive motor 40 rotates the spindle 31, so that the spindle 31 serves as a drive shaft of the drive motor 40. The spindle 31 extends within the tool body 15 in the longitudinal direction of the tool body 15. The lower end of the spindle 41 protrudes downwardly from the lower end of the motor housing 21 on the side of the workpiece W. On the other hand, the upper end of the spindle 41 is positioned proximal to the upper end of the head housing 36. The lower end of the spindle 41 is rotatably supported by a lower ball bearing 51 mounted within the lower end of the motor housing 21. The upper end of the spindle 41 is rotatably supported by an upper ball bearing 52 mounted within the upper end of the head housing 36.

As described above, the drive motor 40 is configured as a brushed motor. More specifically, the drive motor 40 includes a field 42, an armature 43, a commutator 44 and carbon brushes 45. The field 42 serves as a stator. The armature 43 serves as a rotor. As will be described later in detail, the field 42 and the armature 43 are disposed within the motor housing 21 of the housing 20. On the other hand, the commutator 44 and the carbon brushes 45 are disposed within the head housing 36.

The field 42 is fixedly mounted within the motor housing 21. The armature 43 and the commutator 44 are fixedly mounted to the spindle 41. The commutator 44 electrically contacts the carbon brushes 45 to supply an electric power to the armature 43 that generates a magnetic field to cause rotation of the armature 43 relative to the field 42, so that the spindle 41 rotates with the armature 43.

The field 42 includes a field body 421 and coils 422. The field body 421 is opposed to the armature 43. The coils 422 are would around the field body 421. The vertical length of the field body 421 is set to be substantially the same as the vertical length of the armature 43. The field 42 configured in this way may be fixedly attached to an internal housing portion 25 of the motor housing 21 by means of screws 54 or any other suitable fixing device.

Electric components including a controller 46, a capacitor 47, a terminal base 48, a speed-change controller 49, etc. may be disposed on the upper side of the commutator 44 and the carbon brushes 45. A switch 50 for switching on/off of a supply of a power source to the tool unit 15 is positioned proximal to the commutator 44 and the carbon brushes 45. The speed-change controller 49 can receive an operation input from a speed-change operation dial 491. The operation dial 491 is mounted to the head housing 36 and is exposed externally of the head housing 36 as shown in FIG. 1. Therefore, the rotational speed of the spindle 41 can be set according to the operation input from the operation dial 491. The switch 50 can receive an operation input from an on/off operation member 501. The operation member 501 is mounted to the head housing 36 and is exposed externally of the head housing 36 as shown in FIG. 1. Therefore, the power source of the tool unit 15 can be switched on and off according to the operation input from the operation member 501.

An air-blow fan 53 is disposed within a space defined between the field 42 (or the armature 43) and the lower ball bearing 51. The fan 53 is fixedly mounted to the spindle 41, so that the fan 53 rotates with the spindle 41 and produces a stream of air flowing from the lower side toward the upper side within the housing 20. As shown in FIG. 4, a power source cord 55 extends from within the upper portion of the tool unit 15 to the outer side of the tool unit 15. The power source cord 55 has a plug (not shown) connectible with an electrical outlet, so that an electric power can be supplied to the tool unit 15 via the power source cord 55. A cord guard 56 covers the power source cord 55. A clamp member 57 clamps the power source cord 55 together with the internal housing portion 25 that will be explained later. In this way, various electric components are disposed within the head housing 36 at the upper portion of the tool unit 15. A plurality of openings 37 are formed in the head housing 36 for the flow of air.

As described previously, the housing 20 includes the motor housing 21 and the head housing 36 that are integrated together.

The field 42 and the armature 43 of the drive motor 40 are disposed within the motor housing 21. The base device 60 can clamp the contact surface 35 of the motor housing 21. The motor housing 21 has a double housing structure including the internal housing portion 25 and an external housing portion 31 that are integrated together. The external housing portion 31 has a cylindrical tubular shape and is fitted on the internal housing portion 25 to cover the outer circumferential surface of the internal housing portion 25. Therefore, the motor housing 21 has a two-layer structure in cross section, in which the internal housing portion 25 and the external housing portion 31 are coaxially positioned adjacent to each other in a radial direction.

The internal housing portion 25 disposed on the inner side of the motor housing 21 is opposed to the drive motor 40 in the radial direction. The internal housing portion 25 may be made of an insulation material, such as synthetic resin, having an electrical insulation property and also having a thermal insulation property. As shown in FIG. 4, the lower end of the internal housing portion 25 extends to a level where the air blow fan 53 is positioned, and the upper end of the internal housing portion 25 extends to a level where the commutator 44 is positioned. Although the upper end portion of the internal housing portion 25 around the commentator 44 has an intricate configuration, the remaining portion of the internal housing portion 25 on the lower side of the commutator 44 has a substantially cylindrical tubular configuration with a bottom positioned around the commutator 44.

On the other hand, the external housing portion 31 defines the outer circumferential surface of the motor housing 21 that is opposed to the base device 60 in the radial direction. The external housing portion 31 may be made of material that is different from the material of the internal housing portion 25. Preferably, the external housing portion 31 may be made of material having a mechanical strength higher than that of the material of the internal housing portion 25. For example, the external housing portion 31 may be made of aluminum. As shown in FIG. 4, the lower end of the external housing portion 31 extends to a position around the lower ball bearing 51, and the upper end of the external housing portion 31 extends to a position around the commutator 44. A portion of the external housing portion 31 positioned on the lower side of the commutator 44 has a substantially cylindrical tubular configuration with a bottom positioned around the lower ball bearing 51. The remaining portion of the external housing portion 31 including a portion around the commutator 44 is configured to have a diameter gradually enlarged in the upward direction.

Therefore, the outer circumferential surface of the external housing portion 31 includes the contact surface 35 having a uniform diameter. The contact surface 35 is adapted to be clamped by the inner circumferential surface (clamp surface) of the tubular member 72 of the base device 60 in surface-to-surface contact relationship therewith. When the motor housing 21 is inserted into the tubular member 72 before being clamped, the contact surface 35 can smoothly slidably move along the inner circumferential surface of the tubular member 72. The external housing portion 31 may be a die-cast product and the contact surface 35 may be finished into a vertically straight and smooth surface by a machining operation, such as a cutting operation of the die-cast product. Therefore, the contact surface 35 may have a true cylindrical shape that is accurately vertically straight and smooth.

The upper end of the contact surface 35 extends to a position proximal to the upper end of the field 42 on the side opposite to the workpiece W. More specifically, as shown in FIG. 4, the upper end of the contact surface 35 is positioned slightly below the upper end of the field 42. Here, when the motor housing 21 of the tool unit 15 is clamped by the tubular member 72 of the base device 60 in the state that the tool unit 15 is positioned at a lowest position that is closest to the workpiece W (i.e., a lower movable end), the upper end of the tubular member 72 is positioned on the lower side of the upper end of the contact surface 35. Therefore, in this state, the upper end of the tubular member 72 is positioned on the lower side of the upper end of the field 42. Hence, when the tool unit 15 is positioned at its lowest position that is closest to the workpiece W, the field 42 is positioned inside of a portion of the motor housing 21 having the contact surface 35.

As shown in FIG. 2, a rack 33 is attached to the front portion of the contact surface 35 and extends in a direction (a vertical direction in this example) for inserting the tool unit 15 into the base device 60. A dial mechanism (not shown) is operable for moving up and down the tool unit 15 relative to the base device 60 and has a gear (not shown) that can engage the rack 33. A pair of scales 34 are attached to or marked on the front portion of the contact surface 35 at positions on opposite sides of the rack 33 for providing indication of the position of the tool unit 15 relative to the base device 60.

Figure 5:
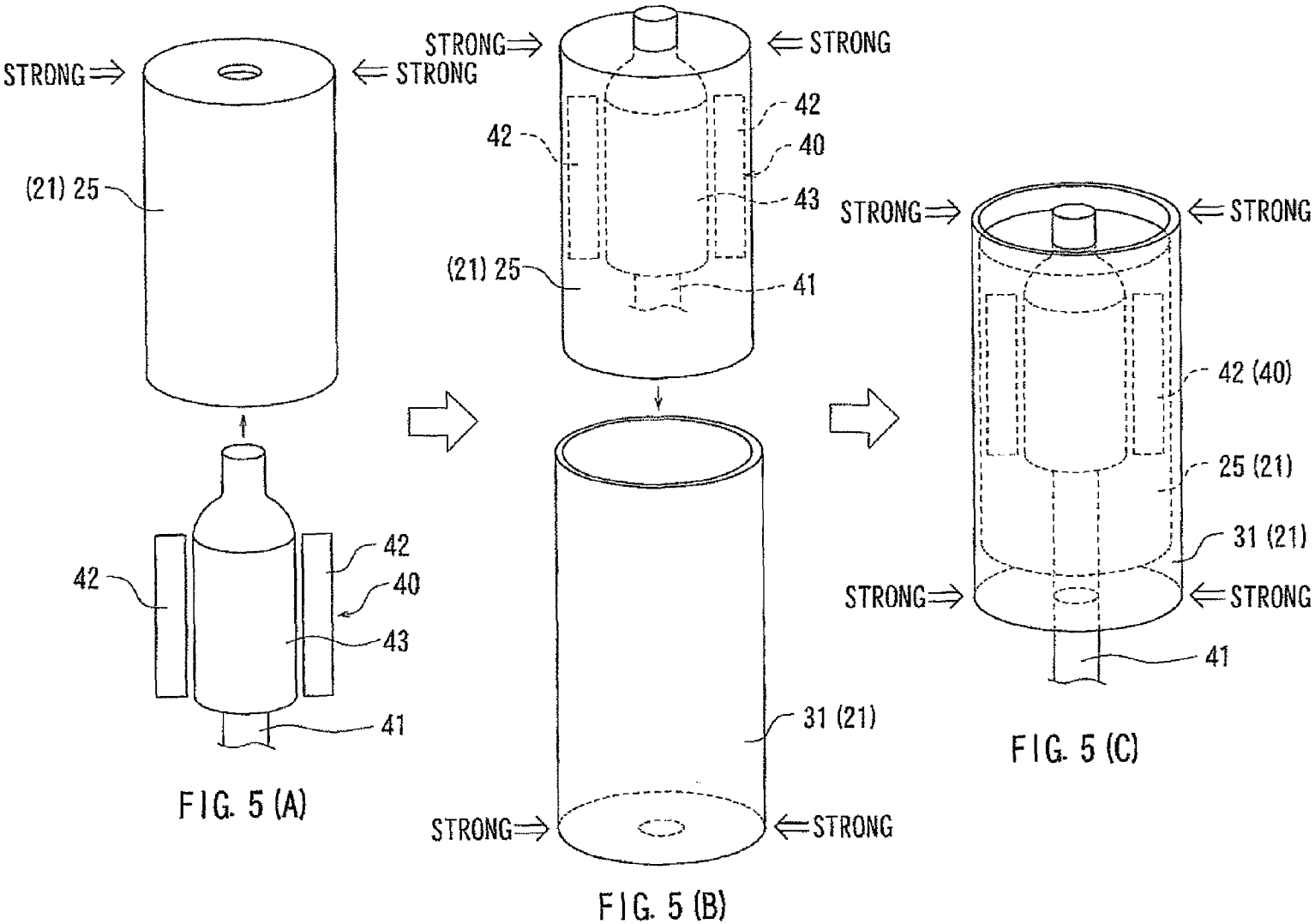
FIGS. 5(A), 5(B) and 5(C) are schematic views showing the steps of assembling the tool unit.

FIGS. 5(A), 5(B) and 5(C) are views schematically showing steps of assembling the internal housing portion 25 and the external housing portion 31. In the step shown in FIG. 5(A), the drive motor 40 is assembled into the internal housing portion 25. In the step shown in FIG. 5(B), the internal housing portion 25 having the drive motor 40 assembled therein is inserted into the external housing portion 31. FIG. 5(C) shows the state where the drive motor 40 has been assembled within the motor housing 21 (having the internal housing portion 25 and the external housing portion 31) after the step of FIG. 5(B). The internal housing portion 25 may be fixed in position relative to the external housing portion 31 by friction (i.e., press fitting). Alternatively, the internal housing portion 25 may be fixed to the external housing portion 31 by using adhesive or any other suitable fixing means.

In this way, the motor housing 21 is assembled according the steps shown in FIGS. 5(A), 5(B) and 5(C) such that the internal housing portion 25 is fitted into the external housing portion 31. As shown in these figures, the moving direction (i.e., the assembling direction) of the drive motor 40 for inserting into internal housing portion 25 is opposite to the moving direction (assembling direction) of the internal housing portion 25 for inserting into the external housing portion 31.

More specifically, in the step shown in FIG. 5(A), the drive motor 40 is positioned on the lower side of the lower opening of the internal housing portion 25 and is moved upward into the internal housing portion 25. As described previously, the internal housing portion 25 has a tubular shape and has a bottom at its upper end. Therefore, a portion of the internal housing portion 25 at a position around the upper bottom has a larger strength against deformation that may be caused due to a potential external force than the strength of the remaining portion. In FIGS. 5(A) to 5(C), arrows with "STRONG" indicate portions that are stronger in strength.

Thus, as shown in FIG. 5(C), in the assembled state of the housing 21, the bottom of the internal housing portion 25 is positioned at the upper end of the housing 21, while the bottom of the external housing portion 31 is positioned at the lower end of the housing 21. Therefore, the strength of the housing 21 is highest at the upper and lower ends than the remaining portion. In this way, in each of the internal housing portion 25 and the external housing portion 21, the open area is larger at the open end than that at the bottom end that may have an opening for inserting the spindle 41.

According to the power tool 10 of the above example, the housing 21 has a double housing structure including the internal housing portion 25 and the external housing portion 31 integrated with each other. The internal housing portion 25 positioned on the inner side and radially opposed to the drive motor 40 may be made of resin, such as synthetic resin. Therefore, it is possible to electrically and thermally insulate the drive motor 40. In addition, because the external housing portion 31 may be made of aluminum, the contact surface 35 defined at the outer circumferential surface of the external housing portion 31 may not absorb moisture. Therefore, the contact surface 35 may not be deformed even in the even that the contact surface 35 has been wetted. In addition, potential change of configuration of the contact surface 35 due to change of temperature may be minimized. In this way, it is possible to ensure insulation of the drive motor 40 disposed within the housing 21 and it is possible to ensure accuracy in size or configuration of the contact surface 35 of the housing 21. As a result, the tool unit 15 can smoothly slide relative to the base device 60.

Further, the assembling direction (moving direction) of the drive motor 40 for assembling the drive motor 40 into the internal housing portion 25 and the assembling direction (moving direction) of the internal housing portion 20 for assembling the internal housing portion 20 having the drive motor 40 into the external housing portion 31 are opposite to each other. Therefore, the direction of the load applied to the internal housing portion 25 by the drive motor 40 during the assembling operation and the direction of the load applied to the external housing portion 31 by the internal housing portion 25 and the drive motor 40 during the assembling operation are opposite to each other. Therefore, the load can be dispersedly applied to the housing 21 during the assembling operation, so that the strength of the housing 21 can be ensured also in this respect.

Furthermore, because the bottom of the internal housing portion 25 and the bottom of the external housing portion 31 are positioned on opposite sides in the vertical direction, the clearance between the internal housing portion 25 and the external housing portion 31 at the open end of the internal housing portion 25 and that at the open end of the external housing portion 31 may be positioned at opposite ends of the housing 21. Therefore, it is possible to minimize potential movement of the internal housing portion 25 relative to the external housing portion 31 after the internal housing portion 25 has been fitted into the external housing portion 31.

Furthermore, the upper end of the contact surface 35 extends to a position slightly below the upper end of the field body 421, and therefore, substantially the entire field body 421 is positioned within the vertical length of the contact surface 35. Hence, the field 42 may support the housing 21 against a potential force applied by the base device 60 when the base device 60 clamps the housing 21 at the contact surface 35. This may serve to accurately maintain the size and the configuration of the contact surface 35.

Furthermore, because the contact surface 35 is finished by the cutting operation, the contact surface 35 may have an accurate true cylindrical shape.

The above example may be modified in various ways. For example, although the power tool 10 is configured as a trimmer used for trimming or grooving wooden workpieces, the above teachings may be also applied to any other power tools, such as routers.

Further, although the direction of assembling the drive motor 40 into the internal housing portion 25 and the direction of assembling the internal housing portion 25 into the external housing portion 31 are opposite to each other, it may be possible that these directions are the same.

Further, although the housing 21 has a double housing structure including the internal housing portion 25 and the external housing portion 31 in the above example, the housing 21 may have one or more additional housing portions (housing layers) provided between the internal housing portion 25 and the external housing portion 31.

What is claimed is:

1. A power tool comprising:

a tool unit configured to be able to machine a workpiece; and a base device defining a base surface for contacting with the workpiece, the base device being configured to support the tool unit with the tool unit positioned relative to the workpiece; wherein:

the tool unit includes a housing and a rotary drive device disposed within the housing, the housing having an outer circumferential surface including a contact surface that is configured to be clamped by the base device;

the housing includes an internal housing portion and an external housing portion that are integrated with each other to form a double housing structure;

the internal housing portion is made of resin and is opposed to the rotary drive device;

the external housing portion is made of metal and defines the circumferential surface of the housing;

each of the internal housing portion and the external housing portion has a substantially cylindrical tubular shape and the internal housing portion and the external housing portion are coaxial with each other;

each of the internal housing portion and the external housing portion has an opening at one end and a partially closed bottom at the other end, the bottom of the internal housing portion and the bottom of the external housing portion are positioned on opposite sides with respect to an axial direction of the housing; and the bottom of the internal housing extends substantially perpendicular to the axial direction.

2. The power tool as in claim 1, wherein the power tool is configured to perform a trimming operation or a grooving operation of a wooden workpiece.

3. The power tool as in claim 1, wherein:

the rotary drive device is assembled into the internal housing portion in a first direction;

the internal housing portion having the rotary drive device assembled therein is also assembled into the external housing portion in a second direction; and the first direction and the second direction are opposite to each other.

4. The power tool as in claim 1, wherein:

the rotary drive device includes a drive motor having a stator and a rotor;

the stator has a first end and a second end, the first end being positioned on the same side as the base surface of the base device and the second end being positioned on the side opposite to the first end;

the contact surface of the housing has a length, so that the stator is positioned substantially within the length of the contact surface.

5. The power tool as in claim 4, wherein:

the contact surface of the housing has a first surface end and a second surface end along the length:

the first surface end being positioned on the side of the base surface of the base device and the second surface end being positioned on the side opposite to the first surface end; and the second surface end being positioned proximal to the second end of the stator with respect to a direction along the length of the contact surface.

6. The power tool as in claim 1, wherein the contact surface of the housing is finished by a machining operation.

7. A power tool comprising:

a tool unit configured to be able to machine a workpiece; and a base device configured to support the tool unit and having a base surface for contacting with the workpiece; wherein:

the tool unit has a housing having an outer circumferential surface and having a drive device disposed therein, the outer circumferential surface including a contact surface;

the base device has a clamp surface configured to be able to clamp the contact surface of the housing for supporting the tool unit;

the housing includes an internal housing portion and an external housing portion positioned on an outer side of the internal housing portion;

the internal housing portion being opposed to the drive device;

the external housing portion defines the circumferential surface of the housing;

the internal housing portion is made of a first material having an electrical and thermal insulation property;

the external housing portion is made of a second material that is different from the first material;

each of the internal housing portion and the external housing portion has a substantially cylindrical tubular shape and the internal housing portion and the external housing portion are coaxial with each other;

each of the internal housing portion and the external housing portion has an opening at one end and a partially closed bottom at the other end, the bottom of the internal housing portion and the bottom of the external housing portion are positioned on opposite sides with respect to an axial direction of the housing; and the bottom of the internal housing extends substantially perpendicular to the axial direction.

8. The power tool as in claim 7, wherein the second material has a mechanical strength higher than the first material.

9. The power tool as in claim 8, wherein the first material is resin and the second material is metal.

10. The power tool as in claim 7, wherein the contact surface of the housing has a substantially cylindrical configuration, and wherein the base device includes a tubular member having a diameter and an inner circumferential surface defining the clamp surface, the tubular member is deformable to change the diameter, so that the clamp surface is pressed against the contact surface of the housing as the diameter of the tubular member decreases.

11. The power tool as in claim 7, wherein the contact surface has a true cylindrical shape.

12. The power tool as in claim 7, further comprising a spindle rotatably driven by the drive device, wherein the bottom of each of the internal housing portion and the external housing portion has a hole through which the spindle extends.

13. A power tool comprising:

a tool unit configured to be able to machine a workpiece; and a base device configured to support the tool unit and having a base surface for contacting with the workpiece; wherein:

the tool unit has a housing having an outer circumferential surface including a contact surface;

the base device has a clamp surface configured to be able to clamp the contact surface of the housing for supporting the tool unit;

the housing includes an internal housing portion and an external housing portion positioned on an outer side of the internal housing portion;

the external housing portion defines the outer circumferential surface of the housing;

the internal housing portion is made of a first material;

the external housing portion is made of a second material that is different from the first material;

each of the internal housing portion and the external housing portion has a substantially cylindrical tubular shape and the internal housing portion and the external housing portion are coaxial with each other;

each of the internal housing portion and the external housing portion has an opening at one end and a partially closed bottom at the other end, the bottom of the internal housing portion and the bottom of the external housing portion are positioned on opposite sides with respect to an axial direction of the housing; and the bottom of the internal housing extends substantially perpendicular to the axial direction.

14. A power tool comprising:

a tool unit that is configured to machine a workpiece and has a housing having an outer circumferential surface and including an internal housing portion and an external housing portion positioned on an outer side of the internal housing portion, each of the internal housing portion and the external housing portion having a substantially cylindrical tubular shape and the internal housing portion and the external housing portion being coaxial with each other, and a base device that is configured to support the tool unit and has a base surface for contacting with the workpiece and a tubular member having a diameter and an inner circumferential surface defining a clamp surface; wherein:

the housing includes a drive device disposed therein, the drive device includes a drive motor having a stator and a rotor, the stator has a first end and a second end in the axial direction, the first end being positioned on the side of the base surface of the base device, and the second end being positioned on the side opposite to the first end in the axial direction, the contact surface of the housing has a first surface end and a second surface end along its length in the axial direction, the first surface end is positioned on the side of the base surface of the base device and the second surface end is positioned on the side opposite to the first surface end in the axial direction, the second surface end of the contact surface is positioned slightly below the second end of the stator in the axial direction, each of the internal housing portion and the external housing portion has an opening at one end and a partially closed bottom at the other end, the bottom of the internal housing portion and the bottom of the external housing portion are positioned on opposite sides with respect to the axial direction of the housing, the external housing portion defining the outer circumferential surface of the housing including a contact surface, the tubular member is deformable to change the diameter such that the clamp surface is pressed against the contact surface to clamp the housing as the diameter of the tubular member decreases and to unclamp the housing as the diameter of the tubular member increases to allow a sliding movement of the housing along the inner circumferential surface of the tubular member in the unclamped state, the internal housing portion is made of a first material that has an electrical and thermal insulation property, and the external housing portion is made of a second material that is different from the first material and has a mechanical strength higher than the first material.

15. The power tool as in claim 14, wherein the first material is resin and the second material is metal.

16. The power tool as in claim 14, wherein the power tool is configured to perform a trimming operation or a grooving operation of a wooden workpiece.

17. The power tool as in claim 14, wherein:

the rotary drive device is assembled into the internal housing portion; and the internal housing portion having the rotary drive device assembled therein is assembled into the external housing portion.

18. The power tool as in claim 14, wherein:

the second surface end is positioned proximal to the second end of the stator with respect to a direction along the length of the contact surface.

19. The power tool as in claim 14, wherein the contact surface of the housing is finished by a machining operation.

20. The power tool as in claim 14, wherein the contact surface has a true cylindrical shape.

21. The power tool as in claim 14, further comprising a spindle rotatably driven by the drive device, wherein the bottom of each of the internal housing portion and the external housing portion has a hole through which the spindle extends.

* * * * *